US007584518B1

(12) United States Patent
Morad

(10) Patent No.: US 7,584,518 B1
(45) Date of Patent: Sep. 8, 2009

(54) ATTACHMENT MECHANISM TO REMOVABLY AND SECURELY RETAIN A CLEANING IMPLEMENT ATTACHMENT ON A BUTTERFLY SPONGE MOP

(75) Inventor: Fred I. Morad, Toluca Lake, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 870 days.

(21) Appl. No.: 11/186,090

(22) Filed: Jul. 20, 2005

(51) Int. Cl.
*A47L 13/12* (2006.01)
*A47L 13/146* (2006.01)

(52) U.S. Cl. ..... 15/116.2; 15/119.2

(58) Field of Classification Search ..... 15/116.1, 15/116.2, 119.1, 119.2
See application file for complete search history.

(56) References Cited

U.S. PATENT DOCUMENTS

| | | | | |
|---|---|---|---|---|
| 1,462,829 | A | 7/1923 | Roberts | |
| 2,701,888 | A | 2/1955 | Vosbikian | |
| 2,895,152 | A | 7/1959 | Vosbikian | |
| 2,916,754 | A | 12/1959 | Zottola | |
| 4,604,767 | A | 8/1986 | Burkhart | |
| 4,654,920 | A | 4/1987 | O'Neil | |
| D290,892 | S | 7/1987 | Slany | |
| D295,912 | S | 5/1988 | Jones | |
| 5,483,720 | A | 1/1996 | Decoopman | |
| 5,488,750 | A | 2/1996 | Vosbikian | |
| D420,775 | S | 2/2000 | Petner | |
| 6,085,378 | A | 7/2000 | Petner | |
| 6,178,581 | B1 | 1/2001 | Lewis | |
| RE37,415 | E | 10/2001 | Petner | |
| 6,336,240 | B1 | 1/2002 | Laux | |
| 6,389,635 | B1 * | 5/2002 | Petner et al. | 15/119.2 |
| 6,588,045 | B2 | 7/2003 | Fernandez | |
| 6,698,056 | B1 | 3/2004 | Oretti | |
| 6,865,768 | B2 * | 3/2005 | Chen | 15/115 |
| 7,225,495 | B2 * | 6/2007 | Berti et al. | 15/116.2 |
| 2004/0016072 | A1 | 1/2004 | Libman | |

FOREIGN PATENT DOCUMENTS

| | | |
|---|---|---|
| EP | 1142526 | 10/2001 |
| WO | WO 01/03566 | 1/2001 |

* cited by examiner

*Primary Examiner*—Randall Chin
(74) *Attorney, Agent, or Firm*—Thomas I. Rozsa

(57) ABSTRACT

The present invention is a cleaning implement such as a scrub brush attachment which removably holds the scrub brush attachment in place on a butterfly mop head and will not fall off during the vigorous scrubbing action because it is locked in place by means of a novel attaching mechanism. The present invention is comprised of a receiving channel molded into the mop head, the channel receiving the unique locking member of the present invention attachment mechanism. The attachment comprises an elongated base member which on one side permanently retains a scrub brush. On the opposite side, the base member comprises a transverse wall supporting the locking member which is an elongated snap wing extending in one direction so that when the snap wing is slid into the receiving channel, the snap wing is press fit into and retained within the receiving channel with the opposite lips of the snap wing abutting opposite elongated interior walls within the receiving channel to lock the base in place within the channel.

15 Claims, 7 Drawing Sheets

ATTACHMENT MECHANISM TO REMOVABLY AND SECURELY RETAIN A CLEANING IMPLEMENT ATTACHMENT ON A BUTTERFLY SPONGE MOP

BACKGROUND OF THE INVENTION

1. Field of the Invention

The present invention relates to butterfly mops and more particularly to a butterfly mop which is provided with a cleaning implement such as a scrubber pad or scrub brush to thereby enable the mop to be used to perform the dual function of washing a floor with a mop in the normal manner, and alternatively to remove soil resistant to removal through washing by applying a brush or an abrasive surface to the floor or wall being cleaned.

2. Description of the Prior Art

In general, wringer mops with scrubber attachments are known in the prior art. The following twenty patents are relevant to the field of the present invention.

1. U.S. Pat. No. 1,462,829 issued to Roberts on Jul. 24, 1923 for "Scraper Attachment For Brooms" (hereafter the "Roberts Patent");

2. U.S. Pat. No. 2,701,888 issued to Vosbikian on Feb. 15, 1955 for "Detachable Bracket For Mops With Cleaning Material" (hereafter the "'888 Vosbikian Patent");

3. U.S. Pat. No. 2,895,152 issued to Vosbikian on Jul. 21, 1959 for "Mops With Replaceable Mop Heads And Extractor Mechanism" (hereafter the "'152 Vosbikian Patent");

4. U.S. Pat. No. 2,916,754 Issued to Zottola on Dec. 15, 1959 for "Mop With Cam Wringer" (hereafter the "Zottola Patent");

5. U.S. Pat. No. 4,604,767 issued to Burkhart on Aug. 12, 1986 for "Wringer Mop" (hereafter the "Burkhart Patent");

6. U.S. Pat. No. 4,654,920 issued to O'Neil on Apr. 7, 1987 for "Sponge Mop With Scrubber Attachment" (hereafter the "O'Neil Patent");

7. U.S. Pat. No. Des. 295,912 issued to Jones on May 24, 1988 for "Wringer Mop Head With Scrubber" (hereafter the "Jones Patent");

8. U.S. Pat. No. 5,483,720 issued to Decoopman on Jan. 16, 1996 for "Sponge Mop" (hereafter the "Decoopman Patent");

9. U.S. Pat. No. 5,488,750 issued to Vosbikian on Feb. 6, 1996 for "Sponge Mop Attachment" (hereafter the "'750 Vosbikian Patent");

10. U.S. Pat. No. Des. 420,775 issued to Petner on Feb. 15, 2000 for "Butterfly Sponge Mop With Integral Molded Head" (hereafter the "'775 Petner Patent");

11. U.S. Pat. No. 6,085,378 issued to Petner on Jul. 11, 2000 for "Self-Wringing Swab Mop With Scrubber" (hereafter the "'378 Petner Patent");

12. U.S. Pat. No. 6,178,581 B1 issued to Lewis on Jan. 30, 2001 for "Mop Scrubber Adapter" (hereafter the "Lewis Patent");

13. U.S. Reissued Pat. No. US RE37,415 E issued to Petner on Oct. 23, 2001 for "Cam Actuated Roller Mop With Scrubber Attachment" (hereafter the "Reissue Petner Patent");

14. U.S. Pat. No. 6,336,240 B1 issued to Laux on Jan. 8, 2002 for "Modular Sponge Mop" (hereafter the "Laux Patent");

15. U.S. Pat. No. 6,588,045 B2 issued to Fernandez on Jul. 8, 2003 for "Roller Self-Wringing Sponge Mop With Scrubber" (hereafter the "Fernandez Patent");

16. United States Patent Application Publication No. US 2004/0016072 A1 to Libman on Jan. 29, 2004 for "Wringer Mop With Removable Mop Head" (hereafter the "Libman Patent");

17. U.S. Pat. No. 6,698,056 B1 issued to Oretti on Mar. 2, 2004 for "Butterfly Sponge Mop With Angle-Adjustable Handle" (hereafter the "Oretti Patent");

18. EP Application No. EP 1 142 526 A1 filed on Nov. 30, 2000 for "Wringer Mop With Removable Mop Head";

19. U.S. Pat. Des. 290,892 issued on Jul. 14, 1987 to Slany for "Combined Floor Scrubber And Mop" (hereafter "Slany Patent");

20. WIPO Patent WO 0/03566 A1 to Petner and assigned to Quickie Manufacturing Corporation (hereafter "Patent WO-01/03566 A1).

The Roberts Patent which issued in 1923 is a scraper attachment for brooms. Specifically focusing on FIG. 1 and on the second column on the first page beginning on Line 64 it states "Bar 6 on both of the edges of its angles is provided with a plurality of apertured lugs or ears 9, by means of which the bar may be securely fastened to the brush block." This is just simply fastening the scraper by three screws to the head of the broom.

The '888 Vosbikian Patent which issued in 1955 is a detachable bracket for mops with cleaning material. This is simply a rectangular bracket for holding bristle broom brushes and contains a screw mechanism by which it is attached to the sponge mop portion.

The '152 Vosbikian Patent which issued in 1959 is dealing with mops with replaceable mop heads and an extractor mechanism. This essentially involves attachment of a brush to a sponge mop and consists of a metal bracket with bolts through it which are fastened by wing nuts.

The Zottola Patent deals with a mop with a cam wringer and also has a method of attaching a brush to the cam wringing portion of the mop. Specifically, the focus of this invention deals with plate 60 which carries brush 22. Plate 60 is secured to plate 41 which has the cam action wringer for the sponge mop through means of bolts passing through the brush 22, plate 60 and plate 41 held in position by knurled nuts 69 and 70.

The Burkhart Patent discloses a wringer sponge mop and scrubber attachment, the scrubber attachment carrying a detachable scrubber pad. Referring to Column 2 beginning on Line 46, the patent states "The scrubber attachment 40 in the embodiment illustrated at FIGS. 1 to 4 is defined by rigid bent wire 46, either integral or of several wire pieces welded together, such that the end portions of the scrubber attachment 40 define a U-portions 47 over which the channel member 42 may be slid. Each one of a pair of arm members extending from U-loop portions 47 includes a loop 48, to thereby define an apertured ear, each loop 48 terminating in an extending arm portion 50. The portions 46, 48, and 50 define a rigid frame member . . . As illustrated in FIG. 4, the pad carrying channel member 42 is slidable on and off of wire frame 45." With respect to the second embodiment most notably illustrated in FIG. 7, the scrubber attachment 100 includes a horizontal run 102 of stiff wire. The numeral 120 denotes a stiff, sheet metal base having a central, longitudinal running channel 122 and longitudinally running overhanging flanges 124 to provide stiffness to the base. Therefore, the wire is slid into this base for purposes of attaching the scrubber.

The O'Neil, Jr. Patent deals with a sponge mop with a scrubber attachment. It includes a scrubber attachment fixedly mounted to a wringer type sponge mop without the necessity for any extra attaching hardware. The scrubber attachment carries a scrubber pad that is secured to the mop head at a predetermined angle. The attachment is best illustrated in FIG. 4 wherein the attachment 40 consists of a plastic plate or sheet. It also includes a pair of ears 46 having a central aperture through which the axles of the sponge mop protrude as illustrated in the cross-sectional views of FIGS. 2 and 3.

The Jones Patent discloses a design patent for a wringer mop head with a scrubber.

The Decoopman Patent deals with a sponge mop. The device includes a scraper as illustrated in FIGS. 13 and 14. The scraper includes a pad 47 secured to the support plate which in turn is fit into a cylindrical member by means of the portion they called finger 49. Referring to Column 10, line 59, the patent states "In order to avoid any untimely disconnection of the pad 47 from the support plate 48, the rail 58 projecting from the front face of said support plate 48 advantageously has a first abutment face 60 situated at one end and a first portion 61 of a snap-fastening system situated near its opposite end. The groove 59 in the rear face of the backing plate 57 then has a second abutment face 62 situated at one end and a second portion 63 of the same snap-fastening system situated towards its opposite. The pad is mounted on the support plate 48 by causing the groove 59 to slide on the projecting rail 58. The sliding is continued until the first and second abutment faces 60 and 62 and also the first and second portions of the snap-fastening system 61, 63 co-operate mutually so as to hold the pad locked in position."

The '750 Vosbikian Patent deals with a sponge mop attachment. The device which holds the scrubber is best illustrated in FIGS. 3 through 9 and includes two detent tabs 14 and 15 which fit into cutouts in the mops 10 and 11. Also, there are openings 19 and 18 to receive a front tip of the squeeze arms 6 and 7.

The '775 Petner Patent appears to have the same structural features of the previous Vosbikian Patent with respect to the attachment of the scrubber, although it does not have the front housing to which the scrubber is attached as in the Vosbikian Patent.

The '378 Petner Patent discloses a self-wringing swap mop with a scrubber. Referring to Column 3, line 24, it states "Attached to flat outer surface 24 is an abrasive scrubber member 26. It will be appreciated that scrubber member 26 can be an abrasive pad, brush or similar course surface which can be permanently attached to the outer surface 24 or attached by means of Velcro."

The Lewis Patent is a mop scrubber adapter. Referring particularly to Column 3, line 32, the patent states "As best shown in FIG. 3, the scrubber adapter 10 has detent tabs 40 which fit the sides and front of the head attachment 16. Two arms 44 extend rearwardly from the scrubber adapter 10, each arm having a side detent tab 40 at an end thereof. In the illustrated embodiment, the side detent tabs 40 are sized for insertion into a notch 48 of the head attachment 16. A front detent tab 50 extends rearwardly from the adapter 10 and is sized to extend from a lower rear edge 52 of the head attachment 16."

The Reissue Petner Patent is a cam actuated roller mop with a scrubber attachment. The mop is combined with an integral mop attachment with an outer abrasive surface, designed and formed to be positioned within a wall surface. The attachment is removable and interchangeable for use on similarly configured roller mops. Referring to Column 4, line 60, the patent states "Frame 14 further preferably supports a removable floor scrubbing mop attachment 20 which has a planar abrasive scrubbing surface 24 as illustrated best in FIGS. 1 and 11." Referring to Column 5, line 18, the patent further states "As seen FIG. 11, removable mop attachment 20 includes a planar support panel 74 and is maintained in position in tunnel housing 42 of frame 14 by side support guides 76 and a central support stop 78, all of which are preferably integrally molded with mop attachment 20 as a single piece of plastic."

The Laux Patent relates to a modular sponge mop. The sponge mop is retained on a backing plate. Referring to Column 3 beginning on line 55, it states "As may best be seen in FIGS. 2 and 8, the backing plate 52 further includes a pair of spaced legs 70, 72 located adjacent opposing lateral sides of the backing plate 52. The legs 70, 72 are adapted to slide through corresponding slots 74, 76 extending into the front edge 18 from the lower side thereof. In addition, each of the legs 70, 72 includes a respective tang portion 78, 80 extending perpendicularly thereto. The tang portions 78, 80 engage a back surface 82 (FIG. 3) of the front edge 18 whereby the backing plate 52 is held in contact with the front edge 18 as it is inserted upwardly to engage the legs 70, 72 within the slots 74, 76."

The Fernandez Patent is a roller self-wringing sponge mop with a scrubber. The scrubber designated as 42 is provided on the narrow end of the mop head 14. The scrubber/scraper 42 includes a scrubbing material 42a and scraper edge 42b. The scrubber/scraper 42 is attached to the mop head 14 in a removable manner such as by projections that slide within undercuts on the end of the mop head 14 and are held tightly by an interference fit.

The Libman Patent Application is a published application which was published on Jan. 29, 2004. This patent application discloses a slot arrangement for retaining a working brush. Referring to Section 46 of the application, it states "For further convenience, the working end 24 of the mop can be provided with a removable brush 92. The brush illustrated in FIG. 22 has a slotted resilient web 93 that fits within a sleeve 95 on the working end of the mop 4 (FIG. 21). The web comprises a depression 97 that engages an internal knob 99 in the sleeve to hold the brush in place."

The European Patent Application is in effect the European publication of the Libman Patent is disclosed above. This is the reason that the application was published. It effectively discloses the same thing as just discussed in the U.S. Libman patent publication.

The Oretti Patent is a butterfly sponge mop with an angle-adjustable handle. The patent also discloses an auxiliary cleaning tool and the method by which it is attached as best illustrated in FIG. 7. Referring to Column 6, the patent states "The illustrated embodiment of the present invention also includes means for selectively mounting an auxiliary cleaning tool 70, such as a scourer or a squeegee, on the front of the body portion 40 of the swivel housing 34. As illustrated in FIGS. 4 and 7, the auxiliary cleaning too 70 is mounted by a mounting plate 72 provided on the auxiliary cleaning tool 70 that is slidably lockable in a complementary key structure 74 formed in the front of the body portion 40."

Going to line 51, the Oretti Patent states "The key structure 74 is advantageously molded of a plastic material such as polypropylene or polyethylene and may be designed and configured to positively permanently snap-fit to the body portion 40 of the swivel housing 34." Also, referring to Column 7 and in particular, FIG. 8, the patent states "The forward edge of the cover 624 is provided with a key structure 626 for securing a tool mounting plate 550. The tool mounting plate has integral slide elements 552, 554 and 556 which cooperate with the key structure 626 to secure the mounting plate to the front of the pivot mop assembly."

The Slany Patent is a design patent that has a scrubber attached to the mop shaft.

The WO 01/03566 A1 Patent, this is the same as the United States Patent to Petner discussed as the Reissue Patent with the scrubber on the self wringing mop.

There is a significant need for an improved attachment mechanism to removably and securely retain a cleaning implement such as a scrubber pad or scrub brush on a butterfly mop.

SUMMARY OF THE INVENTION

The present invention is a cleaning implement such as a scrub brush attachment which removably holds the scrub brush attachment in place on a butterfly mop head and will not fall off during the vigorous scrubbing action because it is locked in place by means of a novel attaching mechanism. The present invention is comprised of a receiving channel molded into the mop head, the channel receiving the unique locking member of the present invention attachment mechanism. The attachment comprises an elongated base member which on one side permanently retains a scrub brush. On the opposite side, the base member comprises a transverse wall supporting the locking member which is an elongated snap wing extending in one direction so that when the snap wing is slid into the receiving channel, the snap wing is press fit into and retained within the receiving channel with the opposite lips of the snap wing abutting opposite elongated interior walls within the receiving channel to lock the base in place within the channel.

It has been discovered, according to the present invention, that for a butterfly mop having a molded head made of materials such as plastic, rubber, or polyurethane, an attachment mechanism comprising at least one snap wing which can be inserted into a channel molded into the butterfly mop head with the at least one snap wing having a opposite lips abutting both interior walls of the molded channel, will enable the mechanism to be securely retained on the mop head and can retain a scrubber pad or scrub brush during vigorous scrubbing action.

It has further been discovered, according to the present invention, that if the mechanism further contains at least one wall or stop member which abuts one end of the channel walls, lateral movement of the mechanism during vigorous scrubbing will be prevented.

It has further been discovered, according to the present invention, that the preferred shape and the receiving channel walls is "L" shaped, however other wall shapes are within the spirit and scope of the present invention.

It has additionally been discovered, according to the present invention, that while at least one snap wing is the preferred embodiment, any configuration having more than one snap wing with the adjacent snap wings extending in opposite directions to be received within the molded channel is within the spirit and scope of the present invention.

It is therefore an object of the present invention to have an attachment mechanism to removably and securely retain a scrubber pad and/or scrub brush attachment on a butterfly mop.

It is a further object of the present invention to provide a mechanism to lock the scrubber pad or scrub brush retained into a receiving channel affixed to a mop head so that the mechanism will not move and will not fall out of the channel during a vigorous scrubbing process.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The innovation of the present invention is a scrub brush attachment which removably holds the scrub brush in place on a molded butterfly mop head and will not fall off during the vigorous scrubbing action because it is locked in place by means of a novel attaching mechanism. The innovation of the present invention is also a scrubber pad attachment which holds the scrubber pad in place on a molded butterfly mop head and will not fall off during the vigorous brushing action because it is locked in place by means of a novel attaching mechanism. The present invention is comprised of a receiving channel molded into and thereby affixed to the molded mop head, the channel receiving the unique locking member of the present invention attachment mechanism. The attachment mechanism comprises an elongated base member which on one side either permanently or removably retains a scrubber pad or permanently retains a scrub brush. On the opposite side, the base comprises a transverse wall which supports the locking member which is at least one snap wing which is snapped into or slid into and retained by a press fit within the receiving channel with the at least one snap wing abutting opposite elongated interior walls within the receiving channel to lock the base in place within the channel.

The base further comprises at least one transversely extending stop member which is located at one end of the at least one snap wing and positioned such that when the at least one snap wing is locked within the channel, the transverse side member is positioned immediately outside one end of the receiving channel so the base cannot move laterally. As a result, the base is firmly locked within the receiving channel and won't move during vigorous scrubbing action.

Figure 1:
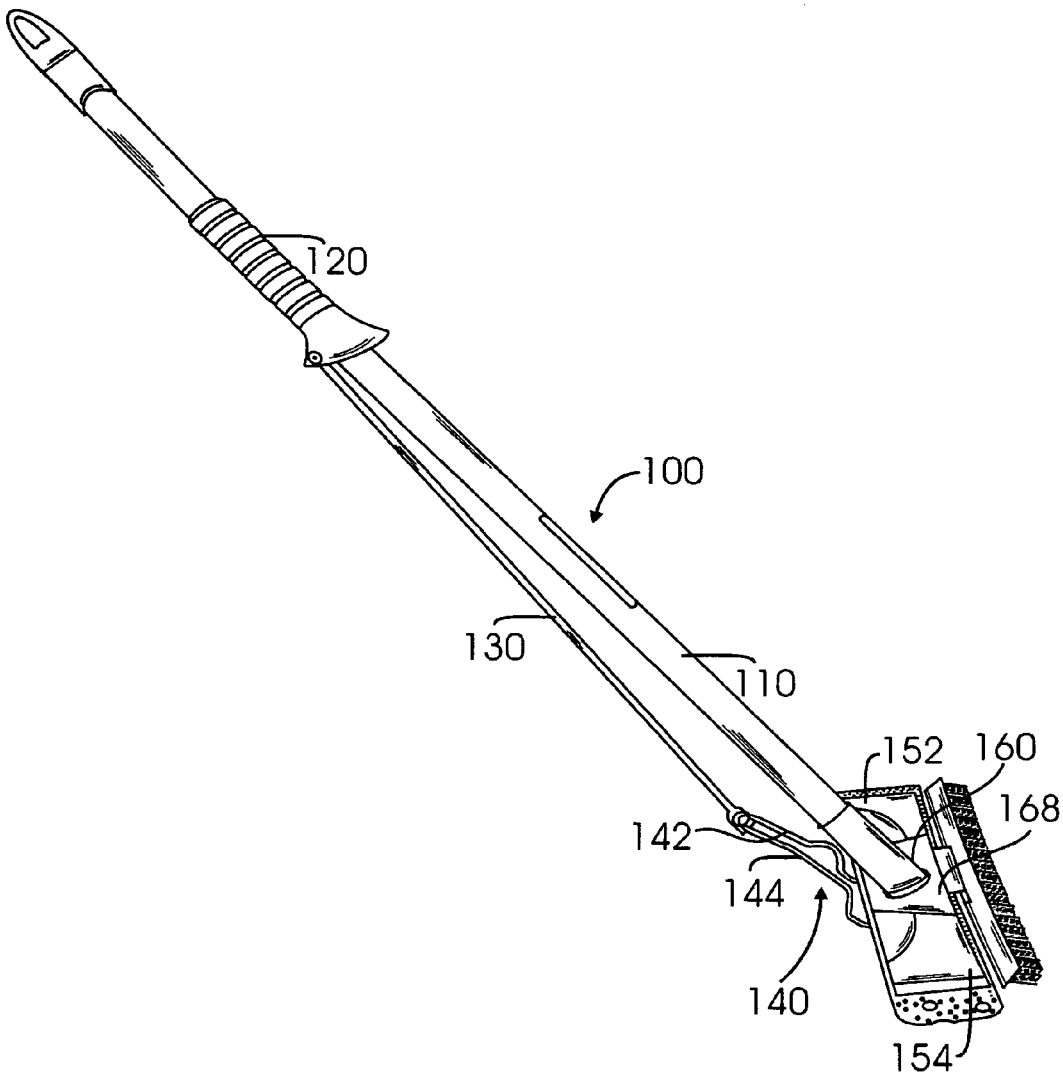
FIG. 1 is a perspective view of a butterfly mop having a molded head and having the present invention receiving channel molded into the head and the cleaning implement removably attached to the butterfly mop through an attaching mechanism received within the molded receiving channel.
Figure 2:
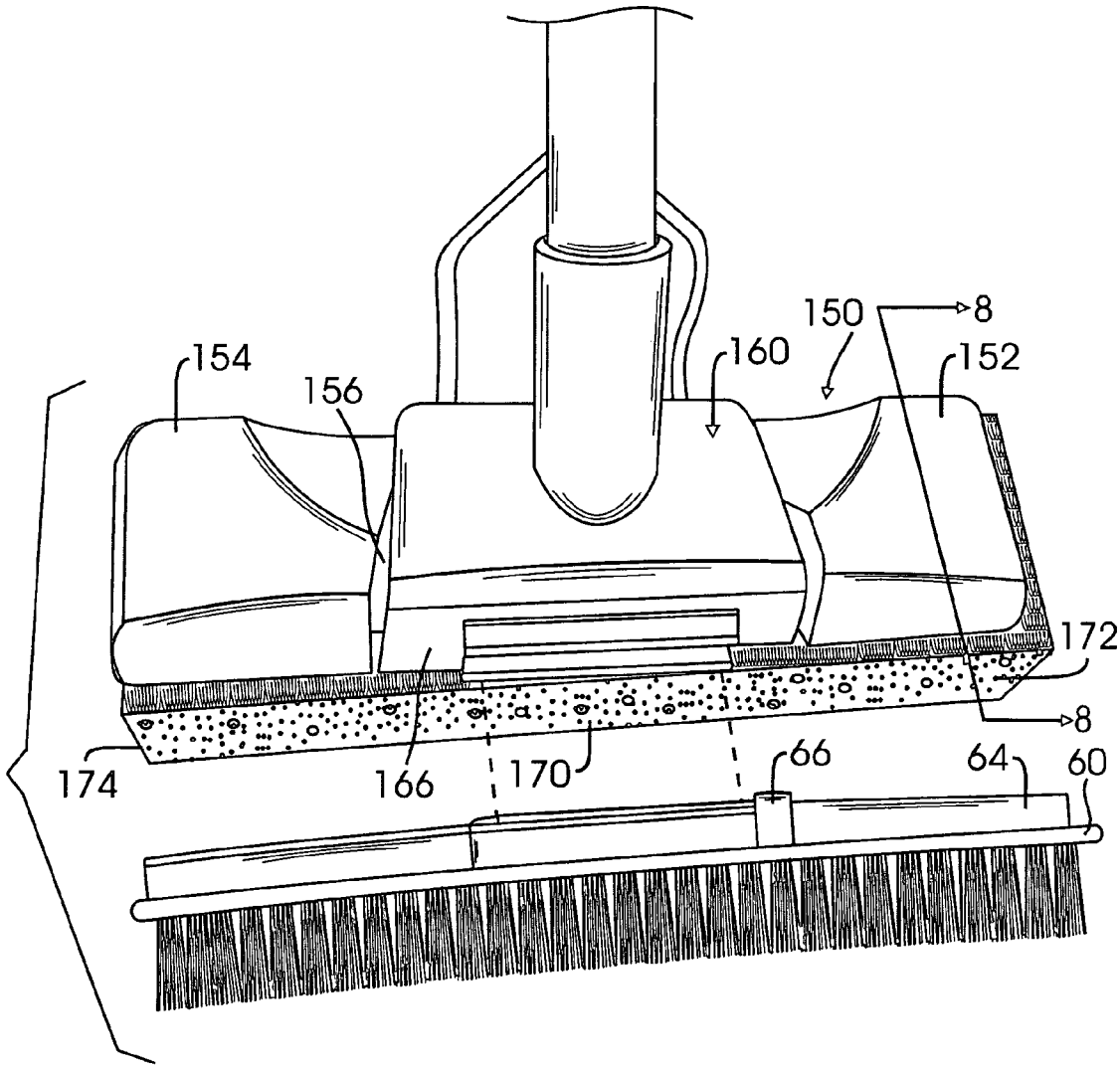
FIG. 2 is an exploded perspective view of the molded head portion of a butterfly mop with the scrubber brush removed to disclose the receiving channel molded into the head of the butterfly mop.
Figure 4:
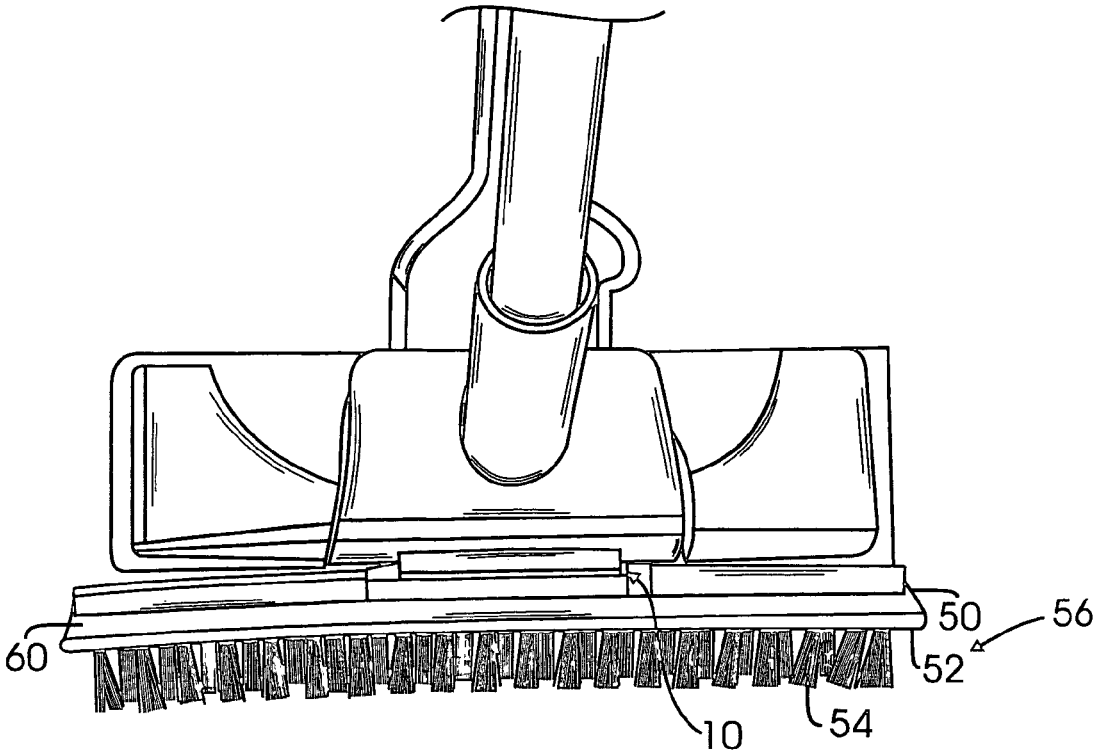
FIG. 4 is a top plan view of the present invention scrubber brush in place on the butterfly mop.
Figure 5:
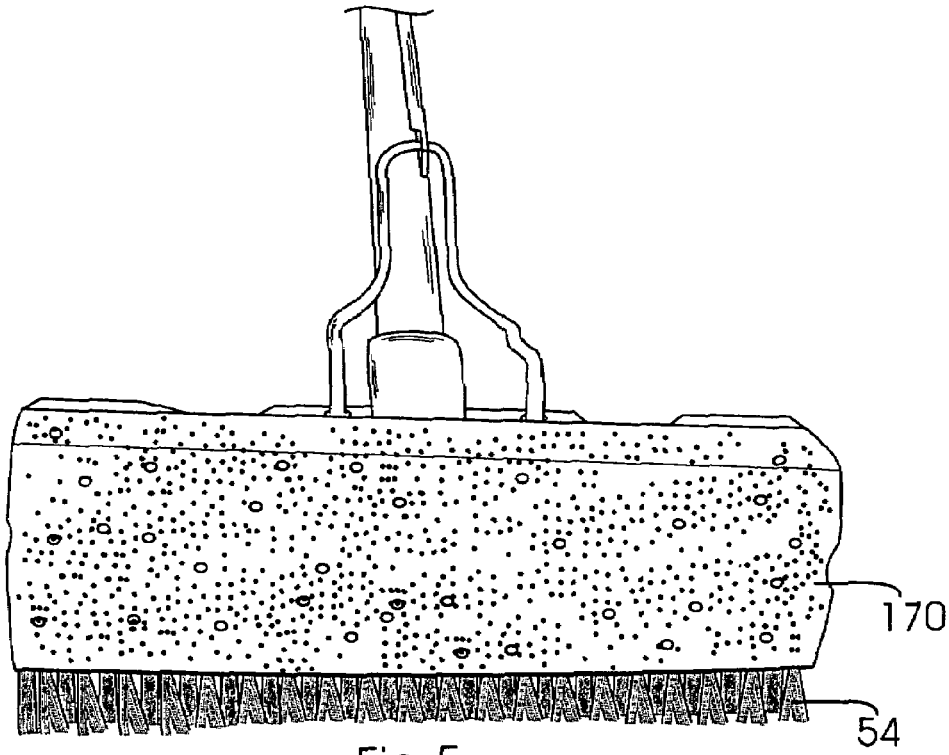
FIG. 5 is a bottom plan view showing the sponge in relation to the scrubber brush.

Referring to FIGS. 1, 2 and 4, there is illustrated at 100 a butterfly sponge mop which has a shaft 110 onto which is positioned a slidable handle 120 connected to a connecting rod 130 which in turn is connected to a butterfly mechanism 140 which is positioned above a molded plate 150 having a left section 152 and a right section 154. The butterfly mechanism 140 has two butterfly operating members 142 and 144 which when activated respectively rotate left section 152 and right section 154 of the molded plate 150. A molded housing 160 is fixed to a location preferably adjacent the bottom of shaft 110 and preferably on the top surface 168 of the molded housing and rests above the top 156 of molded plate 150 and also is positioned between left section 152 and right section 154 of molded plate 150. The fixed molded housing 160 rotatably supports the butterfly mechanism 140 and its operating members 142 and 144 and also rotatably supports the left and right plate sections 152 and 154. A cleaning sponge 170 is attached to the bottom 158 of molded plate 150 by attaching means such as mating hook and loop fasteners 162 and 164, with one fastener 162 attached to the bottom 158 of molded plate 150 and the other fastener 164 attached to the sponge 170. When slidable handle 120 is moved downwardly on shaft 110, the butterfly mechanism 140 which is rotatably supported by the fixed molded housing 160 and the molded plate sections 152 and 154 which are also rotatably supported by the fixed molded housing 160 causes both sections 152 and 154 to rotate downwardly away from fixed molded housing 160 so that side sections 172 and 174 of the cleaning sponge 170 are squeezed together to drain water and dirt from the cleaning sponge 170. When the slidable handle 120 is returned to its normal position, the molded plate sections 152 and 154 and sponge 170 and its sections 172 and 174 rotate back to their normal position. This paragraph describes the normal operation of a conventional butterfly sponge mop 100 having a molded housing 160 including rotatable molded plate 150 and its sections 152 and 154 which supports the sponge 170 and a fixed molded housing 160 attached to the shaft 110 of the butterfly mop 100.

Figure 9:
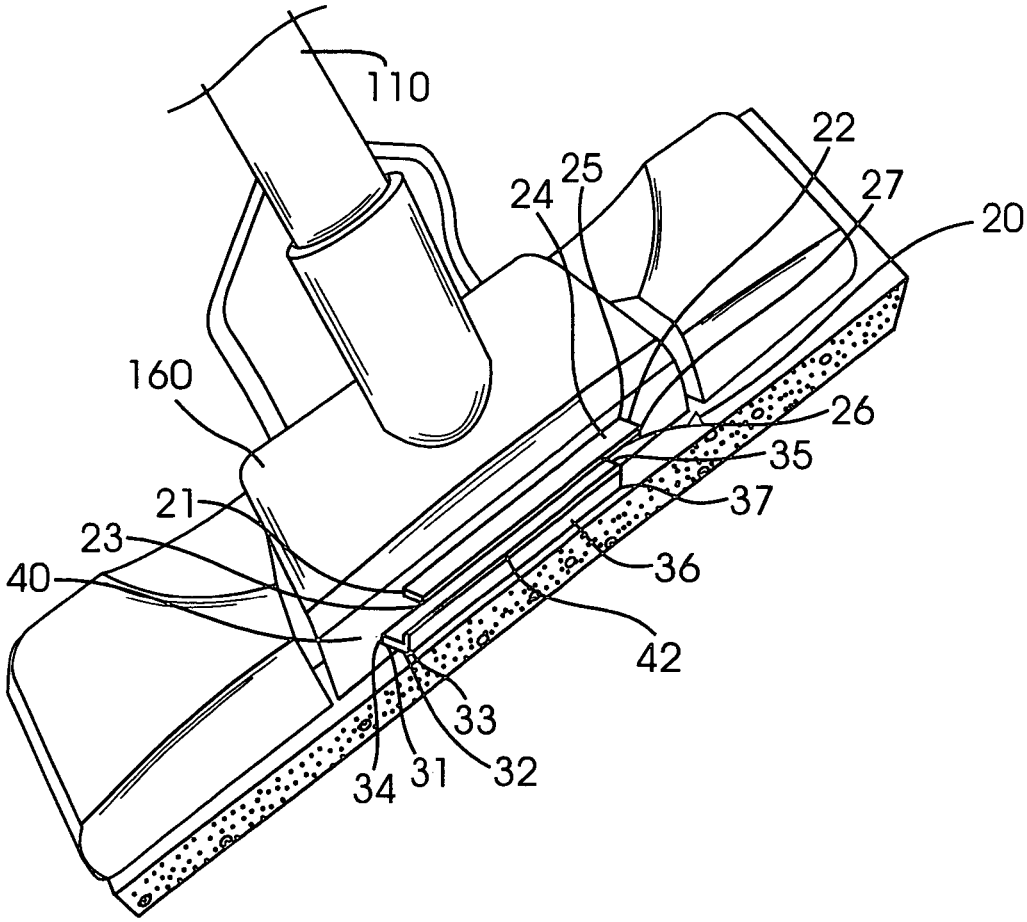
FIG. 9 is a perspective view showing the details of the receiving channel on the housing of the butterfly mop.

Because the fixed head 160 is molded, it is possible to incorporate a molded receiving channel into the head, preferably on the front surface 166. The present invention attachment mechanism 10 addresses the problem found in conventional scrub brush attachment mechanisms which come loose from the head 160 because of vigorous scrubbing action required to loosen the ingrained soil areas. Referring to FIG. 9, the present invention attachment mechanism 10 comprises a receiving member 20 which has a first "L" shaped wall 22 which includes a first sidewall 24 attached to or molded into the head 160 at one end and terminating in a first transverse wall 26 at its other end.

The receiving member 20 further comprises a second "L" shaped wall 32 which includes a second sidewall 34 attached to or molded into the head 160 at one end and terminating in a second transverse wall 36 at its other end. The first "L" shaped wall 22 and the second "L" shaped wall 32 are mirror images of each other so that they are spaced apart with first sidewall 24 aligned parallel to second sidewall 34 and first transverse wall 26 extending toward second transverse wall 36 and second transverse wall 36 extending toward first transverse wall 26 so that a channel 40 is formed between first sidewall 24 and second sidewall 34 and an elongated gap 42 is formed between first transverse wall 26 and second transverse wall 36 which leads into channel 40.

First sidewall 24 terminates in a first transverse end 21 and an opposite second transverse end 25 and first transverse wall 26 terminates in a first transverse end 23 and an opposite second transverse end 27. Similarly, second sidewall 34 terminates in a first transverse end 31 and an opposite second transverse end 35 and second transverse wall 36 terminates in a first transverse end 33 and an opposite second transverse end 37. The transverse ends 21, 23, 31 and 33 are all aligned and transverse ends 25, 27, 35 and 37 are all aligned.

Figure 3:
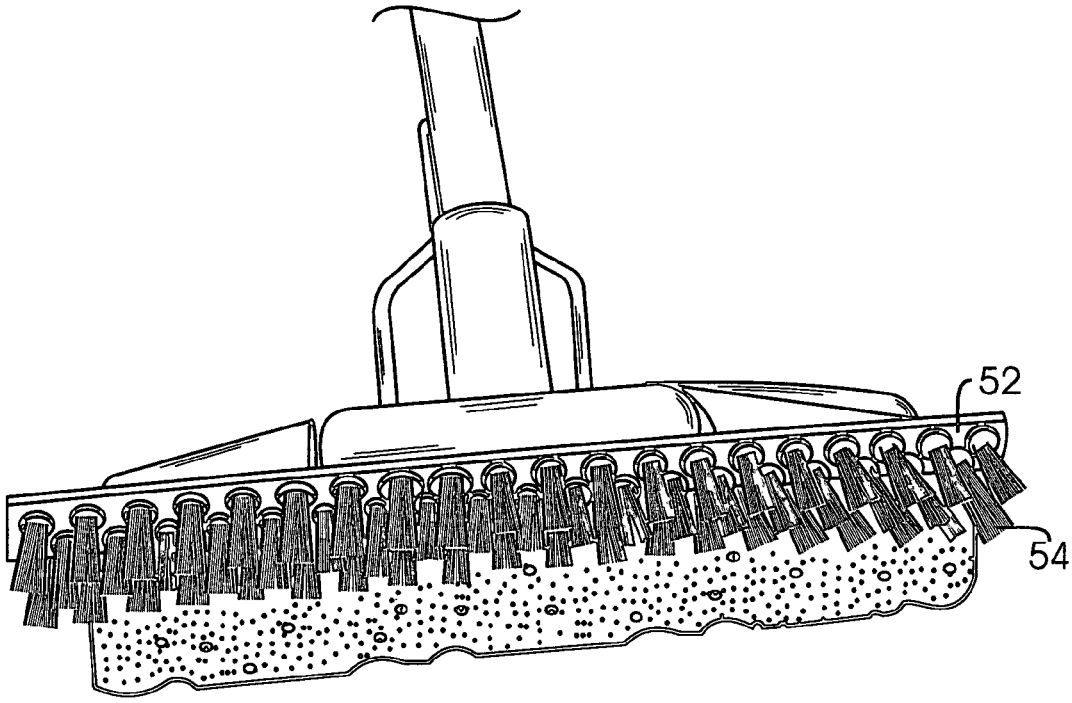
FIG. 3 is a perspective view of the present invention scrubber brush in place on the butterfly mop.

The second component of the present invention attachment mechanism is an elongated base 50 having a front side 52 to which a multiplicity of bristles 54 are attached. The scrubber brush bristles 54 are permanently attached to the front side 52 of elongated base 50. When affixed to the base 50 in this manner, the bristles 54 of scrub brush 56 face outwardly as illustrated in FIGS. 3 and 4 so that the bristles 54 can be rubbed against the wall or floor being washed.

Figure 6:
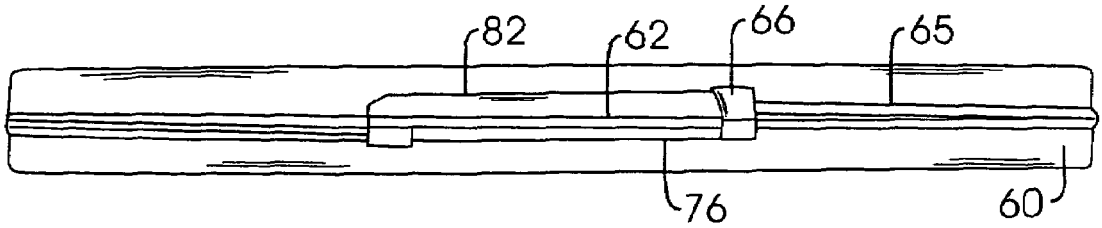
FIG. 6 is a rear elevational view of the head of the scrubber brush showing the at least one snap wing which is received in the receiving channel.
Figure 7:
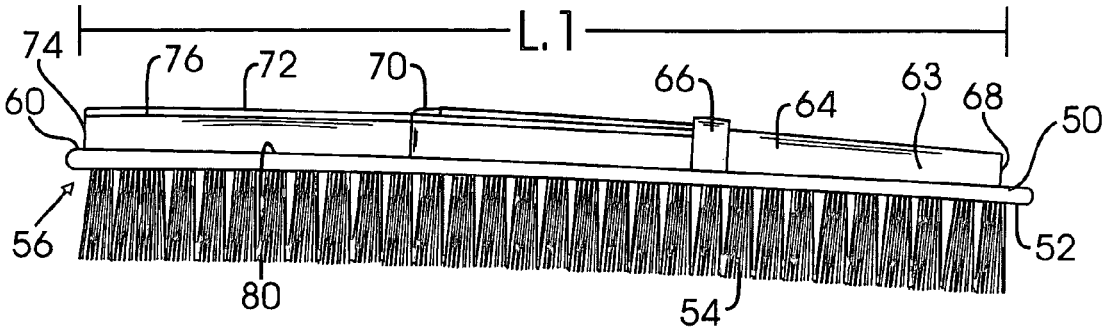
FIG. 7 is a side elevational view from the right side of the scrubber brush head and the snap wing attachment mechanism.
Figure 8:
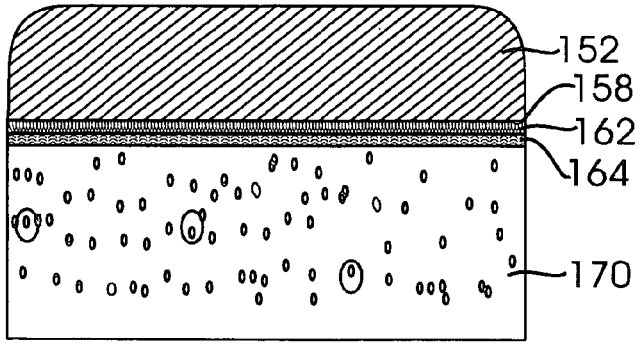
FIG. 8 is a cross-sectional view taken along line 8-8 of FIG. 2.
Figure 10:
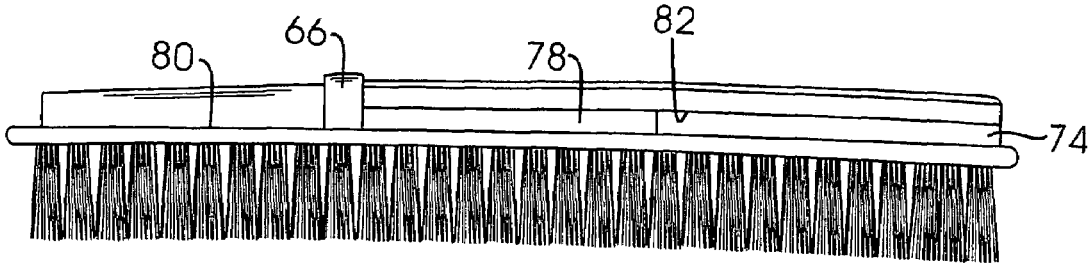
FIG. 10 is a side elevational view from the left side of the scrubber brush head and the snap wing attachment mechanism.

The rear side 60 of elongated base 50 contains the at least one locking member snap wing 62 as best illustrated in FIGS. 2, 6, 7 and 10. A transverse wall 64 extends from the rear side 60 of base 50 and runs almost the entire length of base 50. Positioned at the center of transverse wall 64 is snap wing 62 which extends for approximately one-third (⅓) of the length L1 of transverse wall 64. From the view illustrated in FIGS. 2 and 7, there is a stop block 66 positioned to one side of snap wing 62. The transverse wall 64 is solid from the side 63 opposite the stop block 66 and extending to end 68. An upper elongated groove 70 is formed into wall 64 and is positioned adjacent to top 72 of wall 64 and extends from opposite end 74 through snap wing 62 and terminates at stop block 66. The groove 70 creates an upper lip 76 on one side of the snap wing 62, the upper lip 76 located adjacent the top 72 of transverse wall 64. As illustrated in FIGS. 6 and 10, on the opposite side 65 of transverse wall 64 there is a larger groove 78 which is positioned adjacent to the bottom 80 of the transverse wall adjacent to base 50 and extends from end 74 through the wall of the snap wing 62 and up to the location of the stop block 66 to create a large lower lip 82 on snap wing 62. As illustrated in FIG. 10, the large lower lip 82 is at the approximate mid height of the transverse wall 64.

Figure 11:
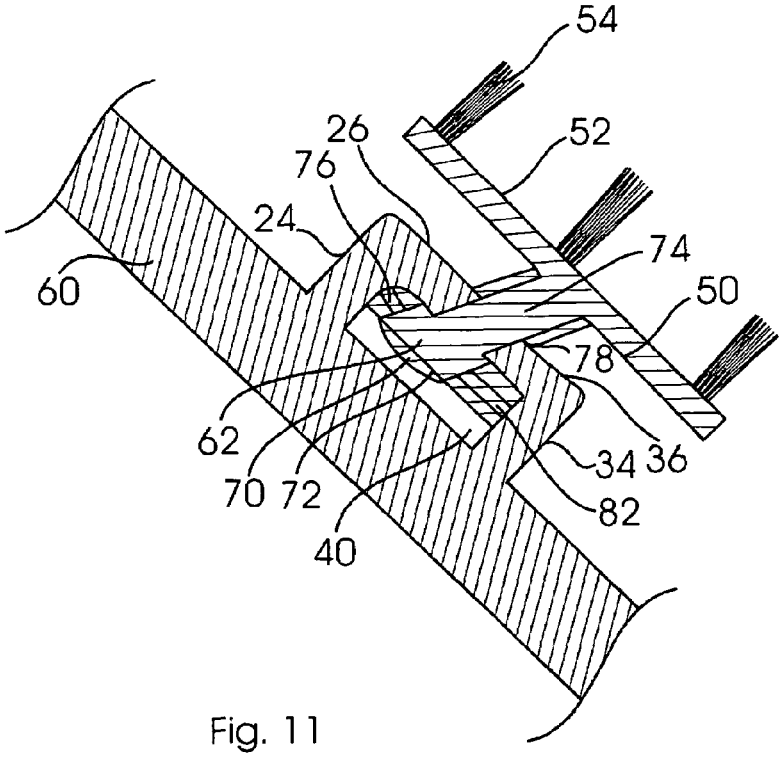
FIG. 11 is a cross-sectional view showing how the base is retained within the receiving member.

As illustrated in FIG. 11, the base 50 is positioned so that the snap wing 62 is aligned with the channel 40 and is slid into channel 40 to form a press fit so that first transverse wall 26 slides into upper elongated groove 70 and upper lip 76 is pressed into the corner between first sidewall 24 and first transverse wall 26. On the opposite side, transverse wall 36 is slides into lower elongated groove 78 and lower lip is 82 is pressed against the interior of second sidewall 34 at a location below second transverse wall 36. The snap wing is press fit slid in this manner until the stop block abuts the end 37 of second transverse wall 36 and the intersection of the end 25 of first sidewall 24 and end 27 of first transverse wall 26 to cause the sliding to stop. In this manner, the snap wing 62 is firmly press fit into channel 40 and retained therein with further lateral movement being prevented by stop block 66. As a result, because of the strong press fit, the butterfly mop 100 can engage in a vigorous scrubbing action with scrub brush 56 so that the scrub brush 56 will not come loose during vigorous scrubbing.

It will be appreciated that numerous alternate configurations are within the spirit and scope of the present invention to have a multiplicity of snap wings to retain the elongated base 50 within the receiving member 20. The present invention will work with any two snap wings with upper and lower lips pointing in opposite directions to be respectively received by transverse walls 22 and 32 of receiving member 20 so that the snap wings are press fit within channel 40 with further lateral movement being prevented by stop block 66.

In the preferred embodiment, the first and second "L" shaped walls 22 and 32 are molded to the front surface of the molded housing.

The molded housing 160, the first and second sidewall 24 and 34, and first and second transverse wall 26 and 36 of the receiving member 20, and the base 50, the transverse wall of the base 64, the upper and lower groove 70 and 78, the upper and lower lip 76 and 82, and the stop block 66 are all formed from material selected form the group comprising plastic, rubber and polyurethane.

In addition to being a brush 56, the cleaning implement can also be a scrubber pad either permanently or removably affixed to the front the base.

Preferably, base 50 is removably retained within the receiving member 20.

Defined in detail, the present invention is a butterfly sponge mop having a shaft with a molded housing having a central section with a top surface affixed to the area adjacent the base of the shaft and also having a front surface, a left molded plate section and a right molded plate section each rotatably affixed to the molded housing, the shaft including a slidable handle affixed to a rod which in turn is affixed to a pair of butterfly operating members rotatably supported on the molded housing, a sponge supported on the bottom of the left and right molded plate sections, an attachment mechanism to retain a cleaning implement on the butterfly sponge mop comprising: (a) a receiving member attached to the front surface of the molded housing, the receiving member further comprising a first "L" shaped wall having a first sidewall attached to the front surface of the molded housing at one end and terminating in a first transverse wall at its other end, the first sidewall having first and second transverse ends and the first transverse wall having first and second transverse ends, and a second "L" shaped wall having a second sidewall attached to the front surface of the molded housing at one end and terminating in a second transverse wall at its other end, the second sidewall having first and second transverse ends, and the second transverse wall having first and second transverse ends, the first and second "L" shaped walls being spaced apart and parallel to each other and a mirror image of each other so that the first sidewall is parallel to the second sidewall and the first and second transverse walls extend toward each other with an elongated gap separating them and leading to an internal channel formed by the first and second "L" shaped walls; (b) an elongated base having a front side to which a cleaning implement is attached, and a rear side comprising a transverse wall having a top, a bottom, a first end, a second end, a first side and second side, a snap wing located along the central area of the transverse wall and terminating in a stop block adjacent one end of the snap wing at the end of the snap wing closest to the second end of the transverse wall, an upper groove in the first side of the transverse wall and running adjacent the top of the transverse wall and extending from the first end through the snap wing and terminating at the stop block, a lower groove in the second side of the transverse wall and running adjacent the bottom of the transverse wall and extending from the first end through the snap wing and terminating at the stop block, the snap wing having an upper lip extending transversely to and running along the top of the upper channel and a lower lip extending transversely to and running along the top of the lower channel; and (c) the elongated base retained by a press fit within the receiving member with first transverse wall sliding into upper elongated groove and the upper lip of the snap wing pressed into the intersection of the first sidewall and first transverse wall and the second transverse wall sliding into the lower elongated groove with the lower lip of the snap wing pressed against the interior of the second sidewall at a location below the second transverse wall, the stop block resting against the second transverse ends of the first and second sidewall and first and second transverse wall of the receiving member so that the cleaning implement extends outwardly from the molded housing so that the base and the cleaning implement remain stationary when the butterfly mechanism is activated to wring water from the sponge and the base and cleaning implement are firmly attached so that they will not come loose during vigorous scrubbing action with the cleaning implement.

Defined broadly, the present invention is a butterfly sponge mop having a shaft with a molded housing having a section affixed to the shaft and also having at least one surface, a butterfly mechanism and a sponge, an attachment mechanism to retain a cleaning implement on the butterfly sponge mop comprising: (a) a receiving member attached to the front surface of the molded housing, the receiving member further comprising a first "L" shaped wall having a first sidewall attached to the at least one surface of the molded housing at one end and terminating in a first transverse wall at its other end, the first sidewall having at least one transverse end and the first transverse wall having at least one transverse end, and a second "L" shaped wall having a second sidewall attached to the front surface of the molded housing at one end and terminating in a second transverse wall at its other end, the second sidewall having at least one transverse end and the second transverse wall having at least one transverse end with all the transverse ends aligned, the first and second "L" shaped walls being spaced apart and parallel to each other and a mirror image of each other so that the first sidewall is parallel to the second sidewall and the first and second transverse walls extend toward each other with an internal channel formed by the first and second "L" shaped walls; (b) an elongated base having a front side to which a cleaning implement is attached, and a rear side comprising a transverse wall having a top, a bottom, a first end, a second end, a first side and second side, a snap wing located along a portion of the transverse wall and terminating in a stop block adjacent one end of the snap wing at the end of the snap wing closest to the second end of the transverse wall, an upper groove in the first side of the transverse wall and running adjacent the top of the transverse wall and extending from the first end through the snap wing and terminating at the stop block, a lower groove in the second side of the transverse wall and running adjacent the bottom of the transverse wall and extending from the first end through the snap wing and terminating at the stop block, the snap wing having an upper lip extending transversely to and running along the top of the upper channel and a lower lip extending transversely to and running along the top of the lower channel; and (c) the elongated base retained within the receiving member with first transverse wall retained in the upper elongated groove and the upper lip of the snap member pressed into the intersection of the first sidewall and first transverse wall and the second transverse wall retained in the lower elongated groove with the lower lip of the snap member pressed against the interior of the second sidewall at a location below the second transverse wall, the stop block resting against the at least one transverse ends of the first and second sidewall and first and second transverse wall of the receiving member so that the cleaning implement extends outwardly from the molded housing so that the base and the cleaning implement remain stationary when the butterfly mechanism is activated to wring water from the sponge and the base and cleaning implement are firmly attached so that they will not come loose during vigorous scrubbing action with the cleaning implement.

Defined more broadly, the present invention is a butterfly sponge mop having a shaft with a housing having a section affixed to the shaft and also having at least one surface, a butterfly mechanism and a sponge, an attachment mechanism to retain a cleaning implement on the butterfly sponge mop comprising: (a) a receiving member attached to the at least one surface of the molded housing, the receiving member having a pair of spaced apart walls having at least one aligned transverse end, which spaced apart walls form an interior receiving channel between the walls; (b) an elongated base having a front side to which a cleaning implement is attached, and a rear side comprising a transverse wall having a retaining member thereon and a stop block positioned adjacent one side of the retaining member, the retaining member having means to receive a portion of the pair of spaced apart walls so that the base is supported and retained within the receiving channel with the stop block located adjacent the transverse end of the spaced apart walls of the receiving member; and (c) the elongated base retained by a press fit within the receiving member so that the cleaning implement extends outwardly from the housing so that the base and the cleaning implement remain stationary when the butterfly mechanism is activated to wring water from the sponge and the base and cleaning implement are firmly attached so that they will not come loose during vigorous scrubbing action with the cleaning implement.

Defined even more broadly, the present invention is a butterfly sponge mop having a shaft with a housing having a section affixed to the shaft and also having at least one surface, a butterfly mechanism and a sponge, an attachment mechanism to retain a cleaning implement on the butterfly sponge mop comprising: (a) a receiving member attached to the at least one surface of the housing, the receiving member having a pair of spaced apart walls which form an interior receiving channel between the walls; (b) an elongated base having a front side to which a cleaning implement is attached, and a rear side comprising a transverse wall having a retaining member thereon, the retaining member having means to receive a portion of the pair of spaced apart walls so that the base is supported and retained within the receiving channel; and (c) the elongated base retained within the receiving member so that the cleaning implement extends outwardly from the molded housing so that the base and the cleaning implement remain stationary when the butterfly mechanism is activated to wring water from the sponge and the base and cleaning implement are firmly attached so that they will not come loose during vigorous scrubbing action with the cleaning implement.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. In a butterfly sponge mop having a shaft with a molded housing having a central section with a top surface affixed to the area adjacent the base of the shaft and also having a front surface, a left molded plate section and a right molded plate section each rotatably affixed to the molded housing, the shaft including a slidable handle affixed to a rod which in turn is affixed to a butterfly mechanism which includes a pair of butterfly operating members rotatably supported on the molded housing, a sponge supported on the bottom of the left and right molded plate sections, an attachment mechanism to retain a cleaning implement on the butterfly sponge mop comprising:

a. a receiving member attached to the front surface of the molded housing, the receiving member further comprising a first "L" shaped wall having a first sidewall attached to the front surface of the molded housing at one end and terminating in a first transverse wall at its other end, the first sidewall having first and second transverse ends and the first transverse wall having first and second transverse ends, and a second "L" shaped wall having a second sidewall attached to the front surface of the molded housing at one end and terminating in a second transverse wall at its other end, the second sidewall having first and second transverse ends, and the second transverse wall having first and second transverse ends, the first and second "L" shaped walls being spaced apart and parallel to each other and a mirror image of each other so that the first sidewall is parallel to the second sidewall and the first and second transverse walls extend toward each other with an elongated gap separating them and leading to an internal channel formed by the first and second "L" shaped walls;

b. an elongated base having a front side to which a cleaning implement is attached, and a rear side comprising a transverse wall having a top, a bottom, a first end, a second end, a first side and second side, a snap wing located along the central area of the transverse wall and terminating in a stop block adjacent one end of the snap wing at the end of the snap wing closest to the second end of the transverse wall, an upper elongated groove in the first side of the transverse wall and running adjacent the top of the transverse wall and extending from the first end through the snap wing and terminating at the stop block, a lower elongated groove in the second side of the transverse wall and running adjacent the bottom of the transverse wall and extending from the first end through the snap wing and terminating at the stop block, the snap wing having an upper lip located adjacent to the top of the transverse wall and a lower lip at a mid height of the transverse wall; and c. the elongated base retained by a press fit within the receiving member with the first transverse wall slidably fitting into the upper elongated groove and the upper lip of the snap wing pressed into the intersection of the first sidewall and first transverse wall and the second transverse wall sliding into the lower elongated groove with the lower lip of the snap wing pressed against the interior of the second sidewall at a location below the second transverse wall, the stop block resting against the second transverse ends of the first and second sidewall and first and second transverse wall of the receiving member so that the cleaning implement extends outwardly from the molded housing so that the base and the cleaning implement remain stationary when the butterfly mechanism is activated to wring water from the sponge and the base and cleaning implement are firmly attached so that they will not come loose during vigorous scrubbing action with the cleaning implement.

2. The attachment mechanism in accordance with claim 1 wherein the first and second "L" shaped walls are molded to the front surface of the molded housing.

3. The attachment mechanism in accordance with claim 1 wherein the molded housing, the first and second sidewall and first and second transverse wall of the receiving member, and the base, the transverse wall of the base, the upper and lower groove, the upper and lower lip and the stop block are all formed from material selected form the group comprising plastic, rubber and polyurethane.

4. The attachment mechanism in accordance with claim 1 wherein the cleaning implement is a brush with bristles retained in the front of the base.

5. The attachment mechanism in accordance with claim 1 wherein the base is removably retained within the receiving member.

6. In a butterfly sponge mop having a shaft with a molded housing having a section affixed to the shaft and also having at least one surface, a butterfly mechanism and a sponge, an attachment mechanism to retain a cleaning implement on the butterfly sponge mop comprising:

a. a receiving member attached to the front surface of the molded housing, the receiving member further comprising a first "L" shaped wall having a first sidewall attached to the at least one surface of the molded housing at one end and terminating in a first transverse wall at its other end, the first sidewall having at least one transverse end and the first transverse wall having at least one transverse end, and a second "L" shaped wall having a second sidewall attached to the front surface of the molded housing at one end and terminating in a second transverse wall at its other end, the second sidewall having at least one transverse end and the second transverse wall having at least one transverse end with all the transverse ends aligned, the first and second "L" shaped walls being spaced apart and parallel to each other and a mirror image of each other so that the first sidewall is parallel to the second sidewall and the first and second transverse walls extend toward each other with an internal channel formed by the first and second "L" shaped walls;

b. an elongated base having a front side to which a cleaning implement is attached, and a rear side comprising a transverse wall having a top, a bottom, a first end, a second end, a first side and second side, a snap wing located along a portion of the transverse wall and terminating in a stop block adjacent one end of the snap wing at the end of the snap wing closest to the second end of the transverse wall, an upper elongated groove in the first side of the transverse wall and running adjacent the top of the transverse wall and extending from the first end through the snap wing and terminating at the stop block, a lower elongated groove in the second side of the transverse wall and running adjacent the bottom of the transverse wall and extending from the first end through the snap wing and terminating at the stop block, the snap wing having an upper lip; located adjacent to the top of the transverse wall and a lower lip at a mid height of the transverse wall; and c. the elongated base retained within the receiving member with the first transverse wall retained in the upper elongated groove and the upper lip of the snap member pressed into the intersection of the first sidewall and first transverse wall and the second transverse wall retained in the lower elongated groove with the lower lip of the snap member pressed against the interior of the second sidewall at a location below the second transverse wall, the stop block resting against the at least one transverse ends of the first and second sidewall and first and second transverse wall of the receiving member so that the cleaning implement extends outwardly from the molded housing so that the base and the cleaning implement remain stationary when the butterfly mechanism is activated to wring water from the sponge and the base and cleaning implement are firmly attached so that they will not come loose during vigorous scrubbing action with the cleaning implement.

7. The attachment mechanism in accordance with claim 6 wherein the first and second "L" shaped walls are molded to the front surface of the molded housing.

8. The attachment mechanism in accordance with claim 6 wherein the molded housing, the first and second sidewall and first and second transverse wall of the receiving member, and the base, the transverse wall of the base, the upper and lower groove, the upper and lower lip and the stop block are all formed from material selected form the group comprising plastic, rubber and polyurethane.

9. The attachment mechanism in accordance with claim 6 wherein the cleaning implement is a brush with bristles retained in the front of the base.

10. The attachment mechanism in accordance with claim 6 wherein the base is removably retained within the receiving member.

11. In a butterfly sponge mop having a shaft with a housing having a section affixed to the shaft and also having at least one surface, a butterfly mechanism and a sponge, an attachment mechanism to retain a cleaning implement on the butterfly sponge mop comprising:

a. a receiving member attached to the at least one surface of the housing, the receiving member having a pair of spaced apart first and second transverse walls having at least one aligned transverse end, the spaced apart first and second transverse walls form an interior receiving channel between the walls;

b. an elongated base having a front side to which a cleaning implement is attached, and a rear side comprising a transverse wall having a top, a bottom, a first end, a second end, a first side and second side, a snap wing located along the central area of the transverse wall and terminating in a stop block adjacent one end of the snap wing at the end of the snap wing closest to the second end of the transverse wall, an upper elongated groove in the first side of the transverse wall and running adjacent the top of the transverse wall and extending from the first end through the snap wing and terminating at the stop block, a lower elongated groove in the second side of the transverse wall and running adjacent the bottom of the transverse wall and extending from the first end through the snap wing and terminating at the stop block; and c. the elongated base retained by a press fit within the receiving member with the first transverse wall sliding into the upper elongated groove and the second transverse wall sliding into the lower elongated groove, the stop block resting within the receiving member so that cleaning implement extends outwardly from the housing so that the base and the cleaning implement remain stationary when the butterfly mechanism is activated to wring water from the sponge and the base and cleaning implement are firmly attached so that they will not come loose during vigorous scrubbing action with the cleaning implement.

12. The attachment mechanism in accordance with claim 11 wherein the pair of spaced apart walls are molded to the front surface of the housing.

13. The attachment mechanism in accordance with claim 11 wherein the housing, the pair of spaced apart walls, the transverse wall of the base, the receiving means of the base, and the stop block are all formed from material selected form the group comprising plastic, rubber and polyurethane.

14. The attachment mechanism in accordance with claim 11 wherein the cleaning implement is a brush with bristles retained in the front of the base.

15. The attachment mechanism in accordance with claim 11 wherein the base is removably retained within the receiving member.

* * * * *